United States Patent [19]

Curci

[11] 3,943,671

[45] Mar. 16, 1976

[54] BUILDING STRUCTURE SUPPORTED ABOVE GROUND BY A CRADLE-LIKE MEANS

[76] Inventor: William A. Curci, 4947 Fulton Drive NW., Canton, Ohio 44718

[22] Filed: Oct. 26, 1973

[21] Appl. No.: 410,195

[52] U.S. Cl. ..... 52/69; 52/73; 52/79; 52/169; 52/194; D13/1 A

[51] Int. Cl.[2] ..... E04B 1/344; E04H 1/12

[58] Field of Search ..... 52/90, 23, 69, 73, 237, 52/79, 169, 194; D13/1 A, 1 R, 1 B; 248/164, 150

[56] References Cited

UNITED STATES PATENTS

| | | | |
|---|---|---|---|
| 321,699 | 7/1885 | Ekman | 248/164 X |
| 1,653,764 | 12/1927 | Goodwin | 248/164 |
| 1,875,403 | 9/1932 | Young | 248/150 |
| 2,786,710 | 3/1957 | Chapman | 52/69 X |
| 3,049,835 | 8/1962 | Sundstrum | 52/169 |
| 3,159,117 | 12/1964 | Rosenfeld | 52/169 X |
| 3,214,872 | 11/1965 | Vogelgesang | 52/169 X |
| 3,283,693 | 11/1966 | Howell | 52/90 X |
| 3,434,253 | 3/1969 | Hatcher | 52/69 |
| 3,511,529 | 5/1970 | Cutsinger | 52/69 X |
| 3,524,287 | 8/1970 | Toselli | 52/639 X |
| 3,617,086 | 11/1971 | King et al. | 52/69 X |
| 3,634,985 | 1/1972 | Tipton | 52/126 |
| D206,870 | 2/1967 | Gilroy | D13/1 A |

FOREIGN PATENTS OR APPLICATIONS

| | | | |
|---|---|---|---|
| 1,468,395 | 2/1967 | France | 52/90 |
| 1,453,984 | 8/1966 | France | 52/90 |
| 884 | 3/1877 | United Kingdom | 248/150 |
| 1,443,198 | 3/1966 | France | 52/79 |
| 1,568,630 | 5/1969 | France | 52/73 |
| 1,232,626 | 10/1960 | France | 52/79 |

*Primary Examiner*—Frank L. Abbott
*Assistant Examiner*—Leslie A. Braun
*Attorney, Agent, or Firm*—Price, Heneveld, Huizenga & Cooper

[57] ABSTRACT

A dwelling for humans comprising a preferably prebuilt housing enclosure which maximizes living space approximately at the eye level of a person seated therewithin. The enclosure is supported above the ground in cradle-like support means which are partially buried and have cradle portions protruding above the ground. The enclosure may be trucked to an installation site since it includes at least one dimension within maximum size limitations for loads to be transported on public highways.

24 Claims, 13 Drawing Figures

BUILDING STRUCTURE SUPPORTED ABOVE GROUND BY A CRADLE-LIKE MEANS

This invention relates to building structures and, more particularly, to a building enclosure supported above ground on a simplified, cradle-like foundation. The structure maximizes living space at a predetermined level, is preferably prefabricated, and is transportable to a desired location via public highways on which maximum load and size limitations are imposed.

BACKGROUND OF THE INVENTION

In recent years, a demand has arisen for vacation-type homes or living units which can be transported on public highways and either temporarily or permanently installed at a desired location. Such structures are generally prebuilt or mass produced in a central location and transported in their entirety to a specified location. Mobile or "trailer" homes are the forerunners of this variety of structure as are camper units designed to be fitted in the bed of a pickup truck. Mass production techniques have also been applied to the production of individual apartment units which are taken to a central location and assembled into apartment houses or complexes.

In each of these cases, since forms of transportation other than land transportation are usually too expensive to be feasible, the size of the living unit, and the living space included therein, is limited by the maximum size limitation for loads which can be transported on public highways. Typically, such living space, which must include space for furnishings, appliances, and the like, has been limited to a width dimension no greater than 12 to 14 feet in the United States. Thus, the problem of obtaining adequate living space in prebuilt, economically transportable living units continues as a difficult design obstacle.

An associated problem with such prebuilt units is the difficulty and expense of installation at a desired location. Typically, prior prefabricated living units have necessitated elaborate foundations requiring formidable construction and preparation prior to the installation of the unit. Such preparation adds greatly to the expense of completing a unit and therefore has reduced the desirability of using prebuilt techniques. Hence the provision of permanent support structures which are simple, efficient, stable, and yet require a minimum of preparation before installation of a prebuilt living unit has also been a difficult problem.

SUMMARY OF THE INVENTION

Accordingly, it is an object and purpose of the present invention to provide a housing enclosure which includes maximized living space therein, is preferably prebuilt and transportable as a complete unit on public highways, and is permanently supported above ground on cradle-like supports which are easily and simply installed prior to mounting of the enclosure thereon. The enclosure has one orientation including a width dimension at approximately the eye level of a person seated within the structure, which dimension is used for maximizing living space. The enclosure also includes at least one dimension within the maximum load dimensions for public highways allowing the unit to be legally transported on such highways. In the preferred embodiment, this result is obtained by designing the enclosure to have one orientation for permanent installation and another for shipping and transportation.

The foundation comprises cradle-like, upstanding support units having braces which engage the converging undersides of the enclosure. The braces extend downwardly in the same directions as the converging sides into the ground where they engage a generally horizontal foot at spaced points beneath the enclosure. Preferably, two of the support units are used, each of which may be easily buried at a desired site prior to the mounting of the housing enclosure such that the cradle-like portions protrude above ground.

In the preferred embodiment, the enclosure has the cross-sectional shape of a square including sides of a length limited to the maximum width transportable on a highway. The unit is therefore legally transportable when resting on one side. When tipped on one corner or edge for permanent installation such that the floor is generally horizontal and two sides of the square converge downwardly, the maximum width becomes the distance from one lateral corner to the other, a dimension greater than the length of one side.

Other features of the invention include a folding porch platform which covers the enclosure entrance when the unit is not is use, and self-contained storage areas and life support equipment.

The present invention, therefore, provides significant advantages over prior known, prefabricated, transportable living units. First, the present invention provides a maximized living space in a prebuilt home which is designed to be transported on public highways having maximum load limitations. Secondly, installation of the enclosure at a location is simple and economical since only two, spaced supports need be buried in the ground and the enclosure either lifted or slid onto those supports for permanent location. Further, the enclosure may include equipment such that it is completely self-contained and therefore may be used effectively even in remote wilderness areas. Also, the entrances and windows included in the unit are built either high above the ground or include hinged coverings which may be locked for security during unattended periods. Accordingly, the unit provides a secure, economical, low maintenance enclosure which may be easily transported to a site and easily erected once having arrived at that location.

These and other objects, advantages, purposes, and features of the invention will become more apparent from a study of the following description taken in conjunction with the drawings.

DESCRIPTION OF THE PREFERRED EMBODIMENT

Figure 1:
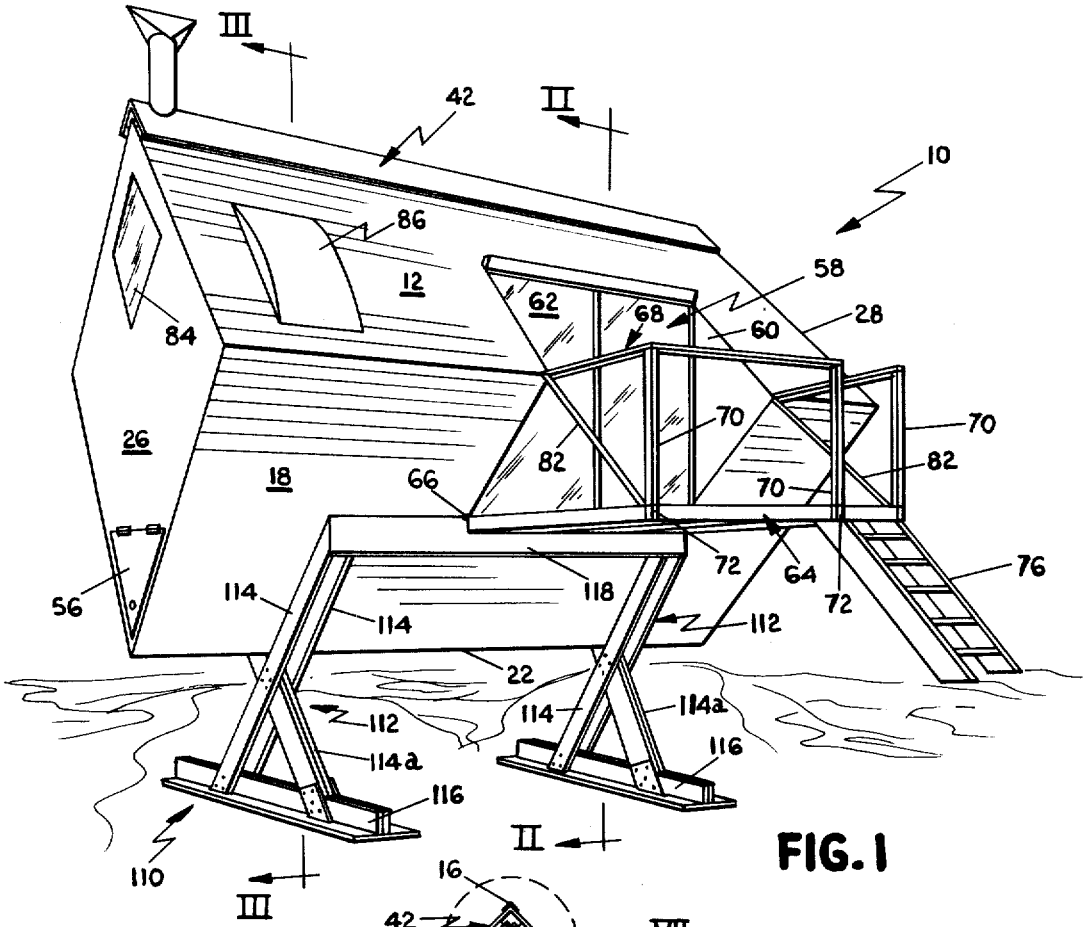
FIG. 1 is a perspective view of the present building structure shown erected on its supporting structure with the ground broken away to show that structure.

Referring now to the drawings in greater detail, FIG. 1 illustrates the prebuilt, modular, housing enclosure 10 erected on a typical building site. The enclosure 10 is self-contained and is cradled and supported above and completely out of contact with the ground by a support structure 110. The support structure is buried at the desired location of the enclosure prior to the arrival of the living unit. Upon arrival, the unit may be lifted or slid into the cradle-like support and permanently secured thereto. Of course, the enclosure may also be built directly at the building site from materials transported separately to the site.

Figure 3:
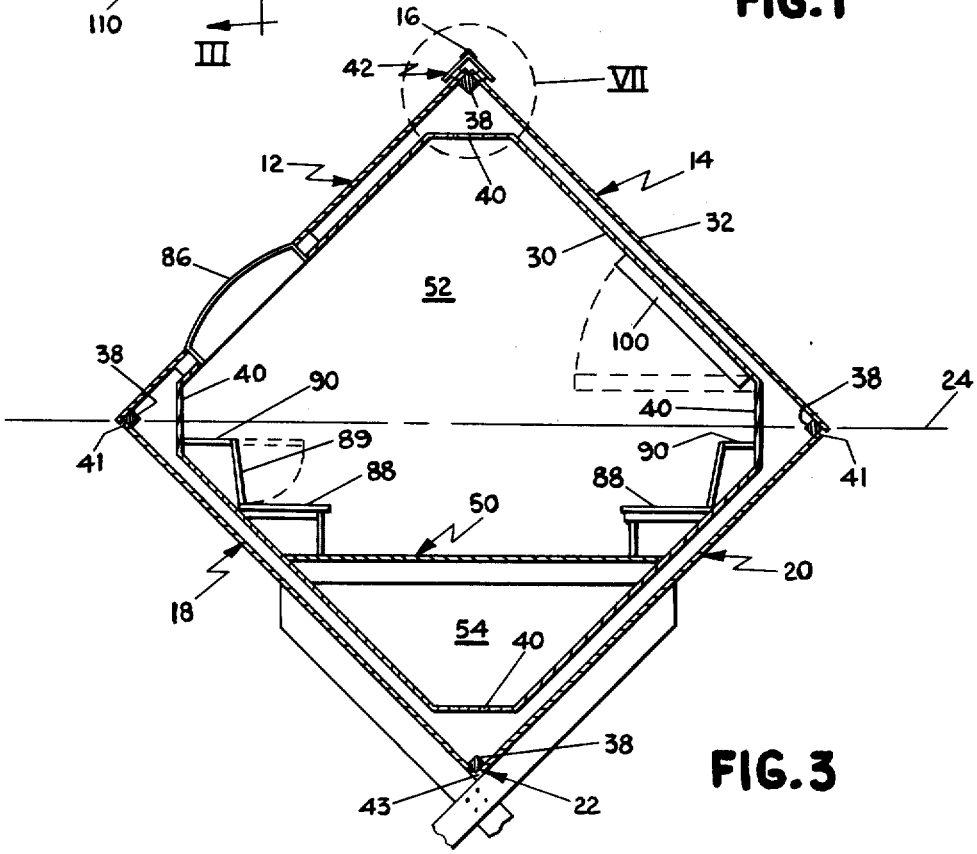
FIG. 3 is another sectional end view of the enclosure taken along plane III—III of FIG. 1.
Figure 2:
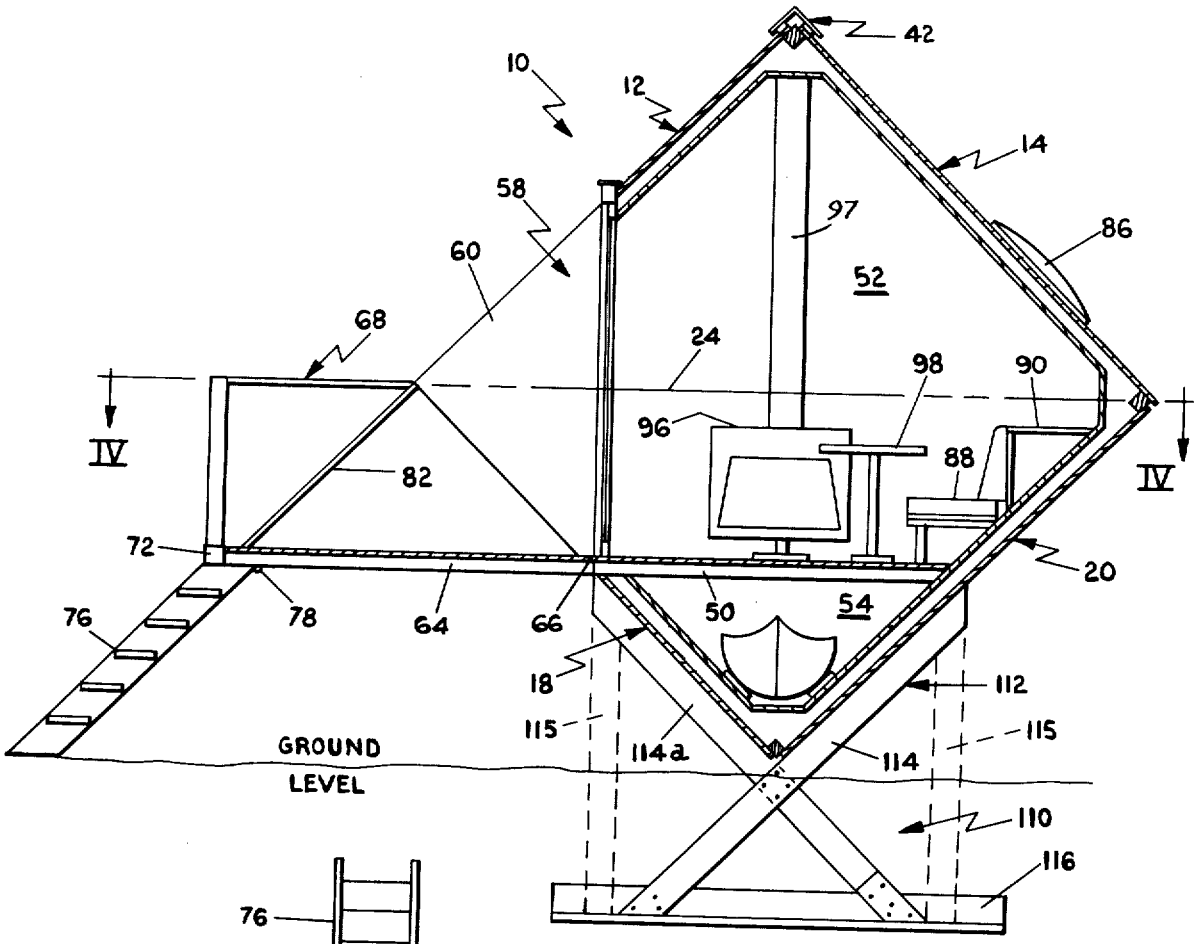
FIG. 2 is a sectional end view of the housing enclosure and support structure taken along plane II—II of FIG. 1.

Referring to FIGS. 1–3, the enclosure includes roof portions 12 and 14 converging upwardly toward a top 16. Side portions 18 and 20 generally converge downwardly toward a bottom 22 from a predetermined level or levels illustrated by line 24 in FIG. 3, where they join the roof portions. The ends of the structure are closed by end panels 26 and 28 as shown in FIG. 1.

Each of the roof, side, and end portions 12, 14, 18, 20, 26, and 28 is formed with a double shell construction including interior and exterior sheets, sheeting, or skins 30 and 32, respectively. Sheets 30 and 32 are spaced apart by spaced studs 34 forming insulation spaces 36 around the complete exterior of the enclosure. Both the interior and exterior skins are load and stress bearing members and actually help support the enclosure in much the same manner as does the metallic "skin" of an airplane fuselage. Ribs 38, which extend the entire length of the enclosure, are provided for securing the exterior shell skin or sheeting 32 together at the respective corners. The corners of the interior shell 30 may be truncated as at 40 to provide reinforcement at the corners and structural continuity of the frame.

Figure 7:
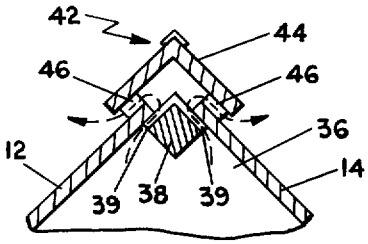
FIG. 7 is an enlarged, fragmentary, sectional view of the vent structure shown in area VII of FIG. 3.

A vent structure 42 (FIGS. 1, 2, 3, 5, and 7) is provided extending along the entire length of the enclosure along its top. As will be best seen in FIG. 7, the vent structure comprises a peak 44 extending the length of the structure and spaced above the apex of the converging roof portions 12 and 14 by spaced blocks 46. The rib 38 at the apex of the roof portions preferably includes grooves 39 at spaced points along its length. Similarly, the remaining ribs 38 also include such grooves 39 at spaced points along their lengths and the exterior skin 32 includes air spaces 41 at the side corners and an air space 43 at the bottom. Thus, air may flow through spaces 41 and 43 from the exterior at the bottom or corners between the inside and outside skins in order to provide continuous ventilation of the space between the skins. Accordingly, any moisture which accumulates between the interior and exterior skins or shells 30 and 32, respectively, can evaporate via the air flow and vent structure.

Figure 8:
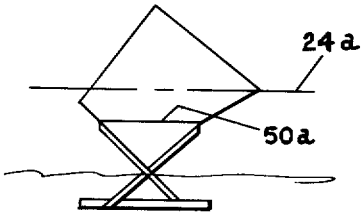
FIGS. 8–11 are schematic illustrations of alternative sectional configurations of the present structure.
Figure 9:
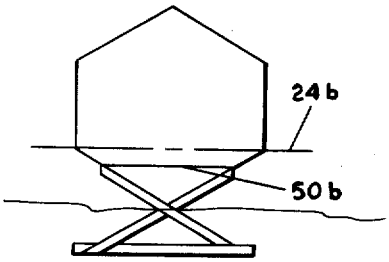
Figure 10:
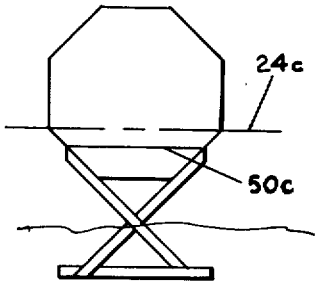
Figure 11:
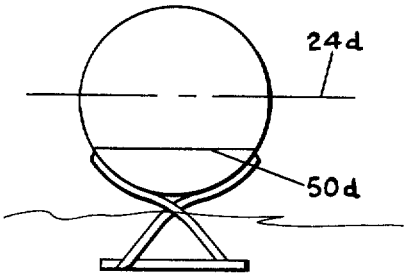

In order to provide the maximum amount of useable living space within the confines of the enclosure 10, a floor 50 is disposed at or below the level designated by line 24 in FIG. 3 between the interior surfaces of the downwardly converging side wall portions 18 and 20. Level 24 may be considered to be the level from which either of the side walls 18 or 20 extends downwardly. As is apparent from FIG. 8, these walls need not extend from the same level. Floor 50 divides the interior space of the enclosure into a living area 52 above the floor and a storage area 54 below the floor. A hinged door or other access means 56 (FIG. 1) is provided to allow access to the storage area such that canoes, skis, camping or fishing equipment, and other bulky objects may be stored therein as shown in FIG. 2. Also, life-support equipment including holding tanks for sewage, drinking water, bottled gas, mechanical and electrical equipment, and the like may be secured within the storage area 54. Accordingly, the living space 52 may be provided with furnishings and appliances and need not include such bulky equipment.

In a preferred embodiment, the enclosure 10 is provided with a single entrance 58 defined by a generally vertical cut-out area 60 extending into the exterior of the enclosure approximately at the widest level 24 (see FIGS. 1, 2, 4, and 5). Preferably, the entrance 58 will extend upwardly from the level of the floor 50 and will include a sliding glass door 62, hinged door, or the like. Entrances could, of course, be provided in other positons such as on the ends of the structure. Extending outwardly from the entrance 58 and generally flush with the level of floor 50 is a porch platform 64 which is hingedly secured to the exterior of the enclosure at the bottom of the entrance at points 66. A removable railing 68, including upright support posts 70 slidingly fitted in socket-like brackets 72 along the outer edges of the platform 64, extends around the periphery of the porch. An opening 74 in the railing at one corner of the platform 64 is provided from which a stairway 76 extends downwardly to the ground level. The stairway 76 is hingedly secured via suitable hinges or the like at point 78. As will be understood from FIG. 5, the entire platform 64 is pivotable between its extended position (FIGS. 2 and 4) to a closed position (FIG. 5) after the railing 68 has been removed from its support brackets. Suitable clasps may be provided such as at points 80 along the edge of the upright platform in order to allow locking means such as padlocks or the like to be used to secure the platform in its closed position. When positioned as at points 80, the padlocks may be reached from the ground level after the platform has been raised. In its open or extended position, the platform is supported from the edges of the cutout area 60 by means of detachable bars, tubes, flexible chains, or the like as shown at 82 in FIGS. 1 and 2.

Figure 6:
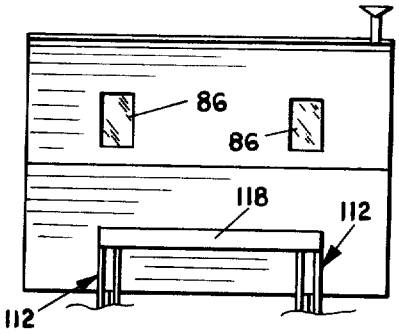
FIG. 6 is a rear elevation of the housing enclosure shown in FIGS. 1-5.

Referring to FIGS. 1–3 and 5–6, windows may be provided in the upwardly facing roof portions 12 and 14 at various points around the enclosure 10. Such windows may be of various configurations including both diamond-shaped windows 84 on the end panels (FIGS. 1 and 5) and domed or other type windows such as those shown at 86 in the front and rear roof portions of the enclosure (FIGS. 1, 3, and 6). Together with the glass door at entrance 58, such windows provide sufficient illumination for the interior of the enclosure. Further, the location of the windows on the upper surfaces enhances the security of the enclosure since such openings would be difficult to reach from the ground level.

Figure 4:
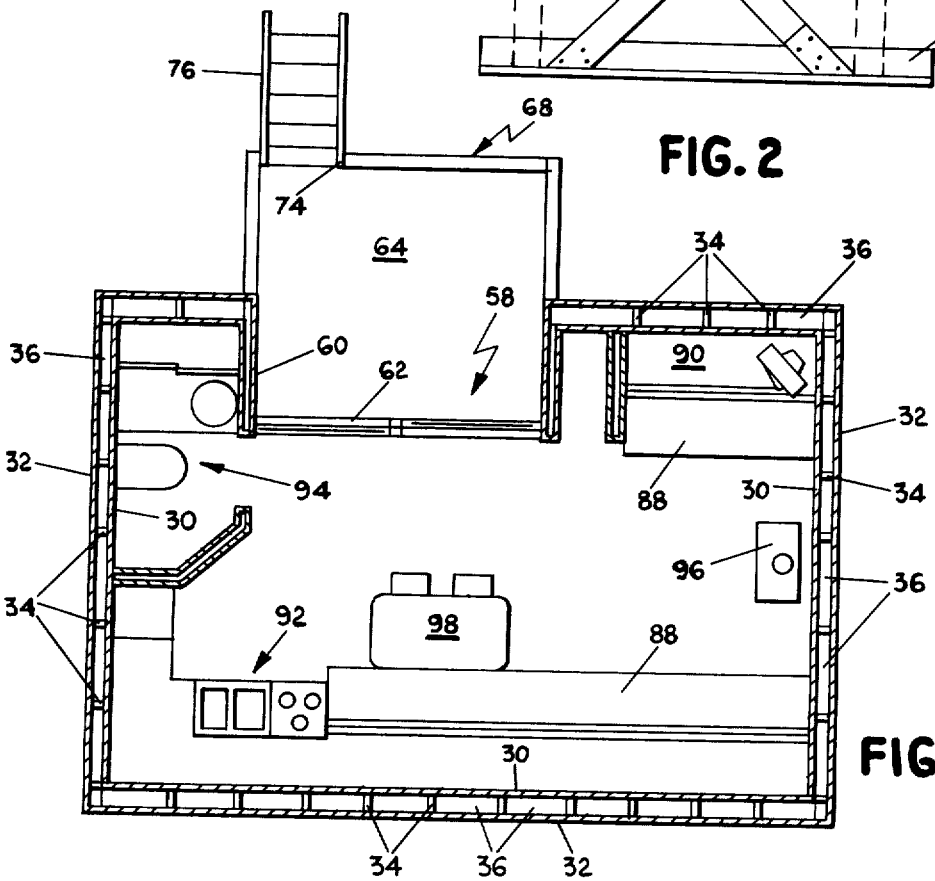
FIG. 4 is a sectional plan view of the enclosure taken along plane IV—IV of FIG. 2.
Figure 5:
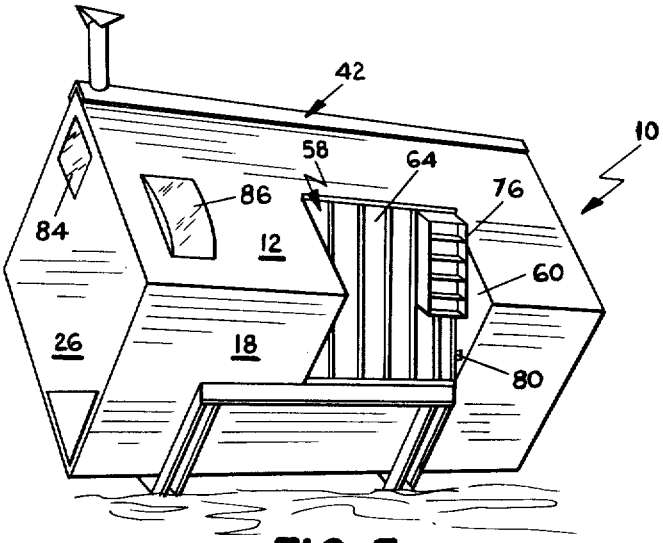
FIG. 5 is a perspective view of the housing enclosure showing the porch platform folded over the entrance when the structure is to be left unattended for periods of time.

Referring now to FIGS. 2–4, it will be understood that the location of the floor 50 below the widest level 24 of the enclosure in its normal, installed orientation, positions the useable living space immediately adjacent and on either side of that level. In order to make maximum use of the full extent of this widest portion of the enclosure, furnishings are built in along the downwardly converging interior sides of the enclosure. The eye level of a person seated on these furnishings will therefore be positioned approximately at the widest port of the installed structure. The furnishings include benches or seats 88, shelves 90, a kitchen area 92, and a lavatory area 94. Also included are a fireplace 96 having a flue 97 extending upwardly through the roof, dining table 98, and bunks 100. The bunks 100 are hingedly secured to the interior of the roof portions such that they may be swung downwardly and supported to provide sleeping space above the bench areas (see FIG. 3). Also, the backs of the benches or seats 89 may be swung upwardly to provide additional sleeping areas. The seats 88 may be extended to provide a wider sleeping area. Accordingly, the maximum width of the enclosure is effectively utilized for living space.

Referring now to FIGS. 1, 2, 5, and 6, the enclosure is supported completely above and out of contact with the ground by a cradle-like support structure 110. The structure 110 includes two support units 112 each including braces 114 and **114*a* which extend downwardly from positions generally between the maximum width level 24 and the bottom 22. Braces 114 and 114*a* cross and are secured to one another at least partially above the ground generally directly beneath the enclosure. (See FIG. 1). They extend into the ground where they are secured to a generally horizontally extending stabilizing, foundation or foot member 116. The support units 112 are spaced apart along the bottom and side portions of the enclosure (FIGS. 1 and 6) and therefore form a cradle-like support which completely stabilizes and secures the enclosure from contact points on the sides 18 and 20 below the widest level 24**.

In the preferred embodiment, cross braces 118 join the upper extremities of the braces 114 and **114*a* (FIGS. 1 and 6) while the braces 114 themselves are sandwiched around braces 114*a* at the points where they cross. The braces 114 and 114*a* in each of the support units 112 therefore form a generally X-shaped support secured to a subterranean foot 116. Solid braces having a rabbit joint or the like where they cross may also be used in place of spaced braces 114 and 114*a* in each unit 112. As shown in FIG. 2, foot member 116 is buried generally beneath the enclosure and generally extends a distance greater than the distance between the vertical projections of the extremities of braces 114 on the surface of the ground. Braces 115 (shown in phantom in FIG. 2) may be used for lateral support. Accordingly, when the braces are secured to foot member 116**, that member forms a stable support which prevents the enclosure from being capsized by wind or other elemental forces.

As mentioned above, each of the support units 112 may be individually buried generally parallel to one another at the desired site of the housing enclosure 10 prior to the arrival of the enclosure. The only preparation required is the digging of two parallel narrow trenches sufficiently deep to allow the upper U- or V-shaped, cradle-like, portions to protrude above ground. The supports therefore require a minimum of preparation prior to the installation of the enclosure thereon and form a stable, permanent, cradle-like support. It is important to note that although the enclosure includes portions which extend out over the extremities of the braces 114, no extra bracing connecting the widest portions of the enclosure with the support structure is required.

Figure 13:
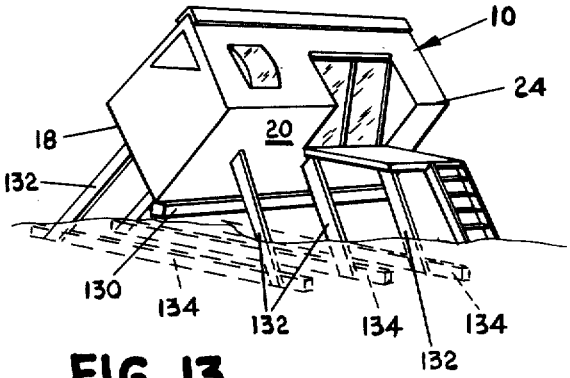
FIG. 13 is a perspective view of another form of the invention using an alternate type of support means.

An alternate method for supporting the enclosure 10 is shown in FIG. 13. In this method, a stabilizing member 130 extends along and under the bottom of the enclosure. Braces 132 are secured to the downwardly converging sides 18 and 20 and extend into the ground for lateral support. The buried ends of the braces 132 may be connected by separate foot members 134 beneath the ground if desired. Typically, member 130 will extend substantially horizontally along the surface of the ground although it may be partially buried.

Referring now to FIGS. 8–11, it will be understood that enclosures having various other cross-sectional configurations may be constructed in accordance with the principles of the present invention. Like the preferred embodiment which has a generally square cross-sectional shape, but which is supported on one corner or edge in a diamond-like orientation, each of the configurations shown in FIGS. 8–11 have a predetermined level denoted by **24*a*, 24*b*, 24*c*, or 24*d*, respectively, from which at least one of the downwardly converging sides extends. In their installed positions, the enclosures shown in these figures are no wider than the width dimensions at these respective levels. These enclosures also include floors denoted 50*a*, 50*b*, 50*c*, and 50*d***, respectively, mounted between the downwardly and generally converging side portions generally below the level of maximum width. Accordingly, in each of these configurations, the maximum useable living space will be located approximately at eye level of a person seated in the general area of the indicated widest dimension.

Further, each of the configurations shown in FIGS. 8–11 may be pernamently and effectively supported by support structures similar to that shown in 110 in the preferred embodiment. In all of these structures, the support structure contacts and engages the enclosure at locations below the maximum width dimension of the enclosure and requires no other bracing.

Additionally, the preferred embodiment (FIGS. 1–7) and the structures in FIGS. 8–11 each have a dimension which is equal to or less than the maximum allowable dimension for loads to be transported on public highways. This dimension is utilized to ship the enclosure to its installation site. That shipping dimension is not necessarily the widest dimension of the enclosure in its installed orientation. For example, if the maximum allowable transportable load must be no wider than 10 feet, the length of each side in the preferred embodiment will be no greater than 10 feet. The widest dimension in the installed position will then be the distance from one lateral corner of the square to the opposite lateral corner, i.e., $$10 \quad \frac{1}{\sin 45^\circ} = \frac{10}{.707} = 14.1 \text{ feet}$$

Figure 12:
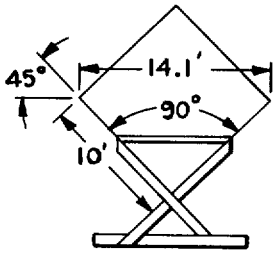
FIG. 12 is a schematic illustration of the enclosure shown in FIGS. 1–7 showing the maximum useable living space.

(see FIG. 12). The width of the maximum useable living space is therefore significantly greater than the length of one side. Similar dimensions can be designed for the other configurations in FIGS. 8–11 in keeping with the spirit of the invention.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A building structure comprising a dwelling for human habitation, said dwelling including a complete integral, prebuilt enclosure having a peaked roof portion and a bottom portion, said roof and bottom portions having a stress and load bearing skin secured to spaced studs; said bottom having sides downwardly converging toward each other; a floor mounted inside said enclosure between said sides below the juncture of said bottom and roof portions; a pair of spaced, X-shaped support means having upper and lower portions with a crossing juncture therebetween, the upper portion of each of said support means being secured to said sides with at least the lower portions of said converging sides engaging said upper portion generally above said crossing juncture thereby providing a V-shaped cradle supporting said enclosure above and in spaced relation to the ground, each support means also having a stabilizing member connected to its lower portion, and each of said stabilizing members and said lower portions of said X-shaped support means being buried in the ground.

2. The building structure of claim 1 wherein said enclosure includes roof portions sloping upwardly and generally convergingly toward one another.

3. The building structure of claim 1 wherein said enclosure includes at least one entrance to the interior thereof, said entrance located generally above the level of said floor.

4. The building structure of claim 3 wherein said enclosure includes a platform on the exterior thereof, said platform extending generally outwardly from and adjacent to said entrance.

5. The building structure of claim 4 including means for pivotally securing the platform to said enclosure; said platform being pivotable between a first position in which it extends away from said enclosure and a second position in which it covers said entrance; and means for retaining said platform in said first and second positions.

6. The building structure of claim 4 wherein said platform includes detachable railings therearound and steps leading thereto.

7. The building structure of claim 1 wherein said enclosure includes at least one window above said level.

8. The building structure of claim 1 wherein said floor defines a space therebelow and between said side portions; and means defining an access to said space.

9. The building structure of claim 1 wherein said support means each include brace members which engage said downwardly converging sides at positions which are located between the lowest extremity of said enclosure and said juncture of said roof and bottom portions; said brace members connecting said engaged positions with said stabilizing member buried in the ground generally below the enclosure, said stabilizing member extending a generally horizontal distance at least as great as the horizontal distance between the vertical projections of said positions.

10. The building structure of claim 9 wherein said brace members engage one another beneath said enclosure and continue separately into engagement with said stabilizing member at spaced points below the ground.

11. The building structure of claim 1 wherein said enclosure has a double shell construction including an inner and an outer skin; said inner skin being spaced from said outer skin by at least one rib and defining an insulation space therebetween; each of said shells being load bearing and helping to support said structure.

12. The building structure of claim 11 wherein said enclosure includes means defining a vent on the exterior thereof and communicating with said insulation space.

13. The building structure of claim 1 wherein furnishings are secured to interior surfaces of said downwardly converging side portions and extend generally between said floor and the level of said juncture between said roof and bottom portions.

14. A building structure comprising a complete, integral, enclosure including a floor defining a space for living or storage thereabove, means defining an entrance to said space, and downwardly extending, generally opposing side portions which generally converge toward a bottom portion; support means for cradling said enclosure completely above the ground, said support means including at least two support units secured at spaced points along said side portions and beneath said bottom portion of said enclosure; each of said support units including support members and a generally horizontal stabilizing member completely buried in the ground which connects said support members generally below said enclosure and under the ground; said support members having bracing portions engaging generally opposing points on said generally opposing, converging side portions and extending downwardly along and matching the contour of said side portions, said support members engaging, crossing, and being rigidly interconnected with each other at a narrow crossing juncture generally below said enclosure to provide a generally V-shaped cradle above said crossing juncture which supports said enclosure above and in spaced relation to the ground and which prevents movement of said enclosure in any direction, said support members extending separately below the surface of the ground for connection with said stabilizing member at spaced points below the ground.

15. The building structure of claim 14 wherein said support members cross and engage each other at least partially above the ground.

16. The building structure of claim 14 wherein said support members each are connected with said stabilizing member below the ground generally beneath the side portion which is opposite to the side portion to which it is connected above the ground.

17. The building structure of claim 16 wherein said support members are rectilinear and cross one another whereby each unit has a general X shape.

18. The building structure of claim 14 wherein said stabilizing member has a length at least as great as the distance between said generally opposing points on said generally opposing side portions.

19. The building structure of claim 14 wherein said support means include cross braces extending along each of said generally opposing side portions and joining the upper ends of said two support units.

20. A building structure comprising a complete, integral enclosure having roof portions sloping upwardly and generally convergingly toward a peaked, top portion and side portions sloping downwardly and generally convergingly toward a bottom portion; a floor interior of said enclosure and defining a space thereabove, said floor being mounted below the juncture of said roof and side portions and extending between said converging side portions; means defining an entrance to said enclosure; a pair of generally vertically extending support means spaced apart from one another along the length of said enclosure, each support means including an upper and lower portion and a stabilizing member connected to its lower portion; said upper portion of each support means including at least a pair of brace members extending along, matching the contour of, and being secured to said downwardly converging sides; said brace members converging to a narrow juncture generally below said integral enclosure to define a V-shaped cradle above said narrow juncture for supporting said enclosure above and in spaced relation to the ground; said upper portion of each support means being rigidly connected to said lower portion to prevent movement of said enclosure in any direction, said brace members including securing means at said narrow juncture for rigidly joining said brace members to resist any movement of said enclosure; each of said stabilizing members and said lower portions of said support means being buried in the ground to stabilize said structure and resist elemental forces acting against said structure.

21. A building structure comprising a dwelling for human habitation and including a multi-sided, rigid, structurally integral and continuous enclosure and support means generally beneath said enclosure for supporting said enclosure completely above ground; said enclosure having a peaked roof portion and a plurality of substantially identically constructed sides lying in different planes and joined together at a plurality of corners, and end panels for closing said enclosure at the ends of said sides, said sides forming a bottom portion with said sides downwardly converging toward each other, a floor mounted inside said enclosure between the side portions below the juncture of said bottom and roof portions; each of said sides including at least one load and stress bearing skin joined to stud means spaced apart along each side for rigidifying said skin; reinforcing means at each of said corners for joining said skins from each side together at said corners to form said stud means and skins into the integral, structurally continuous enclosure, said reinforcing means including at each corner between the adjoining skins from said joined sides at least one of (1) a corner reinforcing member and (2) a longitudinally extending rib for securing said skins together at said corners and rigidifying, reinforcing and strengthening said skins at the corners of said enclosure; a pair of support means spaced apart along the length of said enclosure, each support means having a V-shaped upper cradle portion rigidly connected to a downwardly extending lower portion, said upper portion of each support means being secured to at least the lower portions of said converging sides for support of said enclosure by said V-shaped cradle portion above and in spaced relation to the ground, said rigidly connected upper and lower portions preventing movement of said enclosure in any direction; each support means having a stabilizing member connected to the lower portion of said support means, and each of said stabilizing members and the lower portions of said support means being buried in the ground.

22. The building structure of claim 21 wherein said reinforcing means include elongated rib members extending the length of said enclosure at the corners thereof for joining said exterior skins into a continuous outer shell at said corners, extending between said stud means, and rigidifying said enclosure.

23. The building structure of claim 22 wherein said reinforcing means further include truncated interior corners for joining said interior skins into a continuous interior shell and strengthening said enclosure.

24. The building structure of claim 21 wherein stabilizing member is generally rectilinear; said support means are spaced apart along the length of said enclosure for stable support thereof, each of said pair of support means forming a cradle-like support and including a pair of rectilinear brace members joined in an X-shape at points intermediate their ends, said brace members extending along said converging sides, crossing each other below said enclosure, extending below the ground and being secured to said stabilizing member below the ground, said stabilizing member being generally horizontal.

* * * * *